US006491974B1

(12) United States Patent
Gordon

(10) Patent No.: US 6,491,974 B1
(45) Date of Patent: Dec. 10, 2002

(54) DEVICE AND METHOD FOR DISPENSING FLUID MATERIALS

(75) Inventor: Fergal A. Gordon, Kildare (IE)

(73) Assignee: Loctite (R&D) Limited, Tallaght (IE)

( * ) Notice: Subject to any disclaimer, the term of this patent is extended or adjusted under 35 U.S.C. 154(b) by 272 days.

(21) Appl. No.: 10/049,617

(22) PCT Filed: Aug. 24, 2000

(86) PCT No.: PCT/IE00/00100

§ 371 (c)(1),
(2), (4) Date: Feb. 22, 2002

(87) PCT Pub. No.: WO01/14069

PCT Pub. Date: Mar. 1, 2001

(30) Foreign Application Priority Data

Aug. 24, 1999 (IR) ..... 990723

(51) Int. Cl.[7] ..... B05D 5/10

(52) U.S. Cl. ..... 427/207.1; 118/200; 118/253; 118/256; 118/324; 118/326; 427/420; 427/434.2

(58) Field of Search ..... 427/207.1, 420, 427/434.2; 118/200, 253, 256, 324, 326

(56) References Cited

U.S. PATENT DOCUMENTS

| | | | | |
|---|---|---|---|---|
| 4,485,387 A | 11/1984 | Drumheller | ..... | 346/140 R |
| 4,520,049 A | 5/1985 | Nakanishi | ..... | 427/356 |
| 5,578,151 A | 11/1996 | Andris et al. | ..... | 156/64 |

FOREIGN PATENT DOCUMENTS

| | | | | |
|---|---|---|---|---|
| WO | WO 96/15857 | 5/1996 | ..... | B05C/5/02 |

*Primary Examiner*—Bernard Pianalto
(74) *Attorney, Agent, or Firm*—Steven C. Bauman

(57) ABSTRACT

The invention provides a device and method for dispensing fluid materials from a product reservoir onto a substrate. The device includes at least one dispensing nozzle having at least one inner conduit leading to an exit port and adaptable to be in fluid communication with a supply source for the fluid dispensable material. The nozzle further comprises an end portion defining the exit port such that a ribbon of fluid dispensable material can be applied to the substrate. The nozzle is mountable on means that effect substantially perpendicular free movement of the nozzle relative to the substrate, such that the end portion of the nozzle maintains contact with the fluid material applied to the substrate. During dispensing, movement towards the substrate is effected by an applied force and movement away from the substrate is effected by a thrust exerted by the dispensed fluid material against said end portion of the nozzle and the dispensable material in the exit port.

26 Claims, 14 Drawing Sheets

SECTION X-X

Section X-X

DEVICE AND METHOD FOR DISPENSING FLUID MATERIALS

FIELD OF INVENTION

The invention relates to a dispensing device and method for dispensing fluid materials including liquids and pastes, especially for use with liquid gasketing materials, particularly for the automotive industry.

BACKGROUND OF THE INVENTION

Anaerobic adhesives are used widely in industry for many applications. One particular application is the use of such adhesives as sealants in the provision of gaskets on flanges for use in the combination of parts in the automotive industry. Traditionally, there are two ways to apply a liquid gasketing material in the automotive industry, robotic application or screen printing. Robotic application includes the incorporation of a nozzle onto a programmed automated arm which then moves the nozzle about a substrate in a predetermined manner. Robotic applicators have the advantage over screen printing that as the adhesive is dispensed directly from a single nozzle to the substrate, there is no large surface of adhesive which results in the applicator being more flexible and cleaner. In comparison, as screen printing involves placing a screen over the substrate it only requires the same amount of time for the application of adhesive regardless of the complexity of the dispensed pattern geometry. As a result of advantages of robotic application, there has been a trend towards robotic dispensing but it is desirable to improve the speed and quality of application in such dispensing.

The conventional dispensing equipment uses a needle which is usually positioned 2–3 mm above the substrate to which the adhesive is to be applied. Desirably the substrate is presented at the same height each time, such that the adhesive is applied to a substantially planar substrate. The substrate is desirably mated with stops to ensure consistent substrate height. However, this is not always possible.

In the provision of liquid gasketing materials it is common to use anaerobic adhesives. These adhesives are so called because they do not cure in the presence of air. As such the adhesives are typically supplied in mechanically sealed permeable containers with air contained therein The nature of the constituents of the adhesive, and the fact that it is the absence of air that facilitates curing means it is essential for the adhesive to contact air during storage and prior to application. Otherwise, the shelf life of the adhesive becomes compromised.

As such, it is not uncommon for these products have air bubbles contained therein. The presence of the air bubbles in the adhesive tends to cause breaks in the flow from the container. After the passage of a bubble out of the dispensing tip, normal adhesive is dispensed again, which re-establishes the continuity of the adhesive bead. The height of the nozzle from the substrate and the speed of the robotic dispensing arm affect the quality of adhesive bead being dispensed. If a break occurs and the nozzle is at a large distance away from the substrate then the length of the break as seen on the substrate will be large; similarly it will be understood that the greater the nozzle speed, the larger the break on the substrate.

In commercial application of adhesives to form gaskets on flanges it is not always possible to present the flange substrate to the dispensing nozzle in a consistent planar manner. In such situations the substrate can be presented at varying heights and angles to the robotic dispensing arm. Although it is possible to program the robot to accurately manoeuvre around obstacles on a well presented flange, it is difficult to compensate for fluctuations arising from a badly presented flange. The inability of the robotic dispensing arm to compensate for such fluctuation may result in poorly-applied gasketing materials.

In common applications the smallest adhesive beads that should be dispensed are of approximately 2 g/m$^2$, which is recommended in industry practice to be achieved using a nozzle having a port diameter of 0.8 mm. This preferred port diameter is calculated from a relationship that exists between the cross sectional area of the nozzle port and velocity of fluid product exiting said port and the area of the dispensed bead on the substrate and the velocity of the robot arm. To ensure that an adequate area of adhesive is dispensed using predetermined recommended relationships between the robot and product speed it is calculated that a port diameter of 0.8 mm is sufficient. Depending on the viscosity of the adhesive, the dispensed adhesive bead may be dispensed in a generally semi-circular/circular section on the substrate. It is preferable to achieve the adhesive velocity in the nozzle of approximately twice that of the robotic dispensing arm speed. This minimises the effect of air bubbles entrained in the adhesive. Depending on the application one can tolerate a break of up to about 16 mm in the dispensed bead of adhesive as the adhesive will flow when the substrates are brought together. In the range of about 16–22 mm one observes necking, which although it will heal itself, may form a gasket which is not constant across the width of the substrate. At a gap greater than about 22 mm one may observe a complete break, which results in an incomplete seal when the substrates are brought together and the joint may leak and will either have to be reassembled or repaired.

When the adhesive is applied as a gasketing material to a flange, it is common to use vision inspection systems to ensure quality of application of the adhesive bead, especially when considering the cost of visual inspection as opposed to the cost of reassembly or repair resulting from poorly applied gasketing material. If the vision inspection systems detect any break in the applied bead it is common practice to manually apply additional adhesive at the point of breakage. Additional tests that may be incorporated include the "blow-out" test, which involves the integrity testing of two mated and thereby sealed flanges. After complete assembly the unit is pressurised to approximately ½ bar, the ability of the unit to maintain the pressure being indicative of an adequate seal.

There have been proposals to alter the adhesive product so as to minimise the possibility of breaks occurring in the dispensed bead. This may be achieved by reducing the amount of air within the adhesive product, however, as noted, this comes with a cost of a reduction of shelf life. By refrigeration it is possible to counteract the shelf life reduction somewhat but even so the shortened shelf-life is an added expense and results in problems for manufacturers. Accordingly, it would be desirable to provide a dispensing system which allows for a bead of a liquid product to be applied to a surface with little to no interruption in the bead from air entrained in the liquid product.

SUMMARY OF THE INVENTION

The present invention provides a dispensing device and a process for using said device which allows for the application of high quality beading, in particular in the application of anaerobic adhesives or sealants to form gaskets. The invention is also applicable to other fluid dispensable materials.

In one aspect the invention provides a device suitable for the dispensing of a fluid dispensable material in ribbon form to a substrate. The device includes at least one dispensing nozzle having at least one inner conduit leading to an exit port and adaptable to be in fluid communication with a supply source for the fluid dispensable material, the nozzle having an end portion defining the exit port such that a ribbon of fluid dispensable material can be applied to the substrate, and means for mounting the nozzle for substantially perpendicular free movement relative to the substrate such that the end portion of the nozzle maintains contact with the fluid material applied to the substrate, movement towards the substrate being effected by an applied force and movement away from the substrate being effected by a thrust exerted by the dispensed fluid material against said end portion of the nozzle and the dispensable material in the exit port.

The invention also provides an apparatus for dispensing a fluid product onto a substrate, the apparatus comprising a nozzle and means for mounting the nozzle with at least one degree of freedom allowing movement of the nozzle relative to the substrate with movement towards the substrate being effected by a substantially constant force and movement away from the substrate being effected by a force related to the pressure exerted by the dispensed fluid on the nozzle.

The invention also provides a method for dispensing a fluid dispensable material to a substrate comprising the steps of mounting a dispensing nozzle in a manner which allows substantially perpendicular free movement of the nozzle relative to the substrate, facilitating the application of an applied force on the dispensing nozzle to effect movement of the nozzle in a direction towards the substrate, supplying the fluid dispensable material to an exit port which is defined by an end portion of the nozzle, applying the material to the substrate, and controlling the applied force in relation to a thrust exerted by the dispensed fluid material on the end portion of the nozzle and the dispensable material therein such that the end portion of the nozzle maintains contact with the dispensed material applied to the substrate.

DETAILED DESCRIPTION OF THE INVENTION

Figure 1:
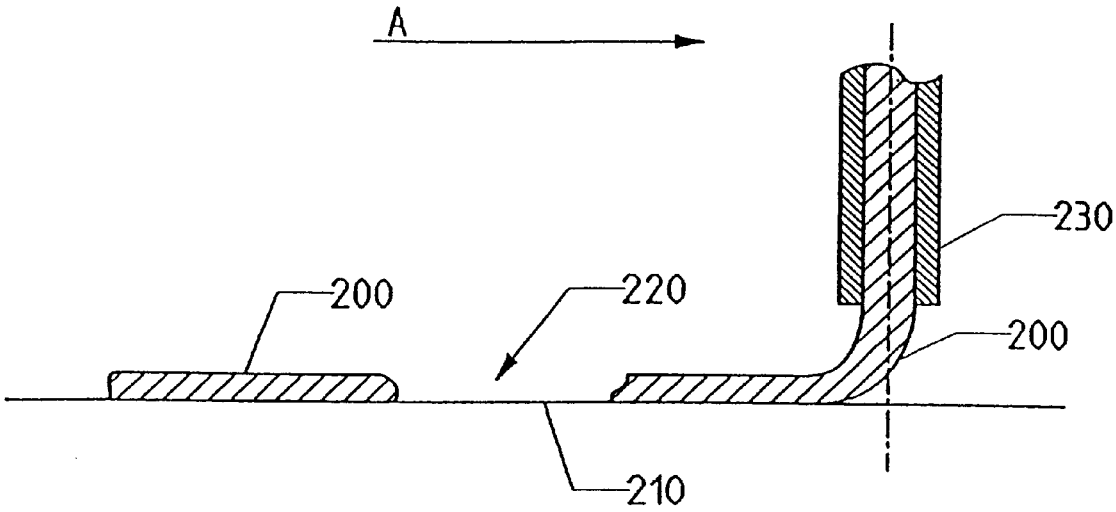
FIG. 1 is a cross sectional diagram, not to scale, showing the application of a dispensed bead of adhesive according to the prior art.

The present invention provides a dispensing device and a process for using said device which allows for the application of high quality beading, in particular in the application of anaerobic adhesives or sealants in a ribbon form to form gaskets on suitable substrates. The invention is also applicable to other fluid dispensable materials.

In one aspect the invention provides a device suitable for the dispensing of a fluid dispensable material in ribbon form to a substrate. The device includes at least one dispensing nozzle having at least one inner conduit leading to an exit port and adaptable to be in fluid communication with a supply source for the fluid dispensable material, the nozzle having an end portion defining the exit port such that a ribbon of fluid dispensable material can be applied to the substrate, and means for mounting the nozzle for substantially perpendicular free movement relative to the substrate, such that the end portion of the nozzle maintains contact with the fluid material applied to the substrate, movement towards the substrate being effected by an applied force and movement away from the substrate being effected by a thrust exerted by the dispensed fluid material against said end portion of the nozzle and the dispensable material in the exit port.

The thrust exerted by the dispensed fluid material against the end portion of the nozzle may be thought of as a buoyant force, and the thrust exerted includes the thrust exerted by the dispensed fluid material on the fluid dispensable material present in the exit port as well as on the end portion of the nozzle i.e. the thrust exerted on the whole surface area within the perimeter of the end portion of the nozzle. The applied force effecting movement towards the substrate may suitably be gravity modulated by control means such as a spring.

Although the invention is not limited by any theory it is thought that the buoyant force is related to a pressure integral or summation of pressure exerted by the dispensed material across the nozzle end portion.

The thrust exerted by the dispensed fluid material is desirably substantially equal in magnitude to the applied force such that the nozzle floats on the dispensed ribbon of material, and an equilibrium between the movement towards the substrate and movement away from the substrate is desirably maintained during the dispensing procedure.

The dispensed fluid is desirably an adhesive/sealant and more desirably an anaerobic adhesive/sealant, which may suitably have a DIN viscosity in the range 7,500 to 90,000 mP·s.

In one embodiment, the device includes a single nozzle having a single inner conduit, the end portion of which is preferably an annular shaped surface, which facilitates the omni-directional movement of the nozzle across the substrate under robotic control.

The end portion of the nozzle may desirably be mounted so that an end face thereof is substantially parallel to said substrate. The end face suitably is a flat face. While the dimensions of the end portion will vary depending upon the desired dimensions of the ribbon and the viscosity of the fluid material to be dispensed in exemplary embodiments the outside diameter of the end portion is in the range from about 2.5 mm to about 10 mm, particularly about 4 to about 6 mm, and the diameter of the exit port defined by said end portion is in the range from about 1 mm to about 5 mm, particularly about 2 to about 3 mm. Using such a nozzle of outside diameter of 4 mm it is possible to apply a ribbon of width 5 mm.

The invention also provides an apparatus for dispensing a fluid product onto a substrate, the apparatus comprising a nozzle and means for mounting the nozzle with at least one degree of freedom allowing movement of the nozzle relative to the substrate with movement towards the substrate being effected by a substantially constant force acting on the nozzle in a direction towards the substrate, and movement away from the substrate being effected by a force related to the pressure exerted by the dispensed fluid on the nozzle.

The invention also provides a method for dispensing a fluid dispensable material to a substrate comprising the steps of mounting a dispensing nozzle in a manner which allows substantially perpendicular reciprocal movement of the nozzle relative to the substrate, facilitating the application of an applied force on the dispensing nozzle to effect movement of the nozzle in a direction towards the substrate, supplying the fluid dispensable material to an exit port which is defined by an end portion of the nozzle, applying the material to the substrate, and controlling the applied force in relation to a thrust exerted by the dispensed fluid on the end portion of the nozzle and the dispensable material therein such that the end portion of the nozzle maintains contact with the dispensed material applied to the substrate.

The substantially constant force which effects movement towards the substrate may be substantially equal in magnitude to the force effecting movement away from the substrate. The force which effects movement of the nozzle towards the substrate may act directly or indirectly on the nozzle.

The supply source for the fluid dispensable material is suitably a product reservoir of conventional type, particularly, a product reservoir such as is conventionally used for anaerobic adhesives. The product reservoir is desirably pressurised such that the product is dispensed under pressure.

It is thought that the force related to the pressure exerted by the dispensed fluid on the nozzle is a buoyant force which is a function of one or more of the following:

a) the pressure exerted by the applied fluid on the nozzle,
b) the pressure exerted by the applied fluid on the fluid in the exit port and,
c) the distance of the nozzle away from the substrate.

The product being dispensed may contain air bubbles which while being dispensed result in less pressure being applied on the nozzle in the direction away from the substrate. In order to maintain the buoyancy force substantially constant, this reduction in pressure is compensated by a reduction in distance of the nozzle from the substrate. The smaller gap between the nozzle and substrate acts to increase the buoyancy force. When the air bubble has been dispensed the pressure of the dispensed liquid effects more pressure on the nozzle, which results in the gap between the nozzle and the substrate increasing to maintain the buoyancy force constant.

The interaction between the nozzle and the dispensed product allows the nozzle to adjust its height relative to the substrate as a result of variations in the dispensed product, while the nozzle is maintained in substantially intimate contact with the ribbon of dispensed fluid during the dispensing procedure.

In a preferred embodiment a ribbon of material is applied onto the substrate at a thickness (perpendicular to the substrate) greater than the surface roughness of the substrate, i.e. greater than the maximum height of any surface projections above the general plane of the substrate surface.

In an alternative embodiment wherein the buoyancy force is less than the force acting towards the substrate then the nozzle may ride on the substrate resulting in local points of contact between the substrate and the nozzle.

In the method of the invention, the fluid may suitably be laid onto the surface in a ribbon of material.

The invention will now be described with reference to the following illustrated examples which are not intended to limit the invention.

Figure 2:
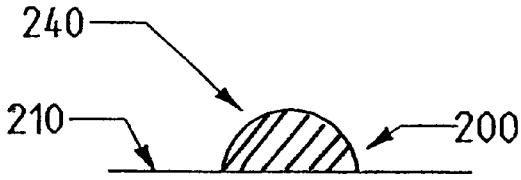
FIG. 2 is a transverse section across a bead of adhesive as dispensed according to FIG. 1.

FIGS. 1 and 2 relate to prior art methods, and are not to scale. FIG. 1 shows a bead 200 of adhesive as dispensed onto a substrate 210 from a nozzle 230, moving in a direction A, parallel to the substrate, according to an existing process. The nozzle 230 is held above the substrate, substantially above the top surface of the bead 200, and so the nozzle is not in contact with the dispensed material. If there is a large bubble in the dispensed material, there will be a break 220 in the bead 200.

FIG. 2 is a transverse section through the bead 200, showing a typical shape profile of the bead on the substrate 210. The top surface 240 of the bead 200 is substantially semi-circular in profile. To achieve a dispensed adhesive bead quantity of 2 g/m$^2$, the bead 200 is typically 1 mm high and 2–3 mm in diameter.

Figure 3:
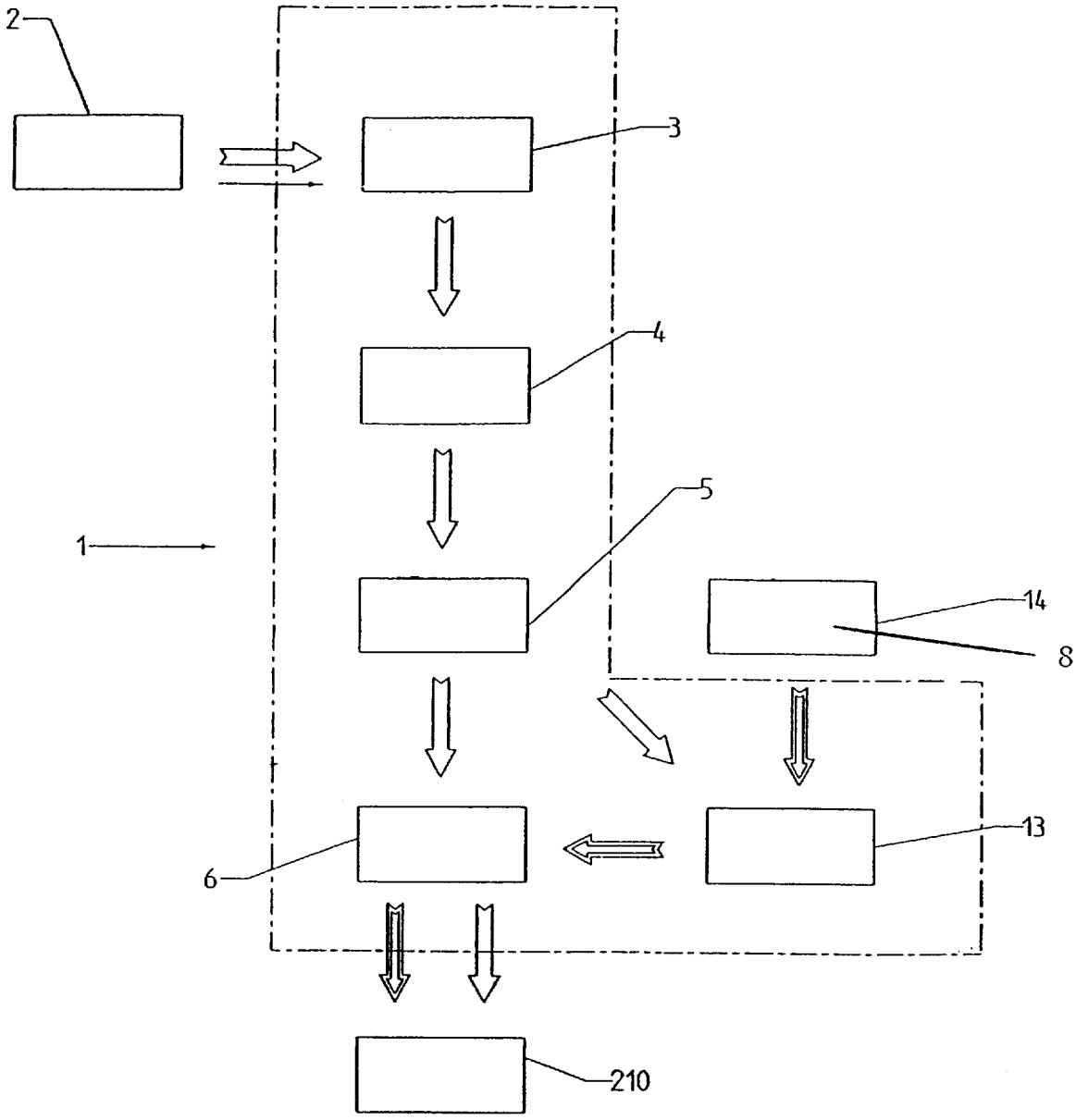
FIG. 3 is a functional block diagram of a robotic dispensing system for use with a device according to the present invention.

FIG. 3 is a functional block diagram showing elements of a robotic dispensing system for use with one embodiment of a device 1 according to the present invention. The interaction between each of the functions is not intended to limit the invention to such conceptual distinct components and it will be appreciated by those skilled in the art that practical embodiments could incorporate two or more functions in one component. The device 1 is adapted to be connected to a robot 2 using a robot interface 3. A kinematic control 4 is provided to maintain the movement of the nozzle in predetermined planes. A force control 5 is incorporated to modulate and control an applied force on a nozzle 6 towards the substrate 210 on which a fluid 8 is to be laid. The nozzle 6 is in fluid communication with feed lines 13 connected to a conventional product reservoir 14, which may be pressurised by an air supplied to the reservoir by a compressed air line. The fluid 8 which is to be dispensed or laid on the substrate passes from the product reservoir 14 through the nozzle 6 and onto the substrate 210.

Figure 4:
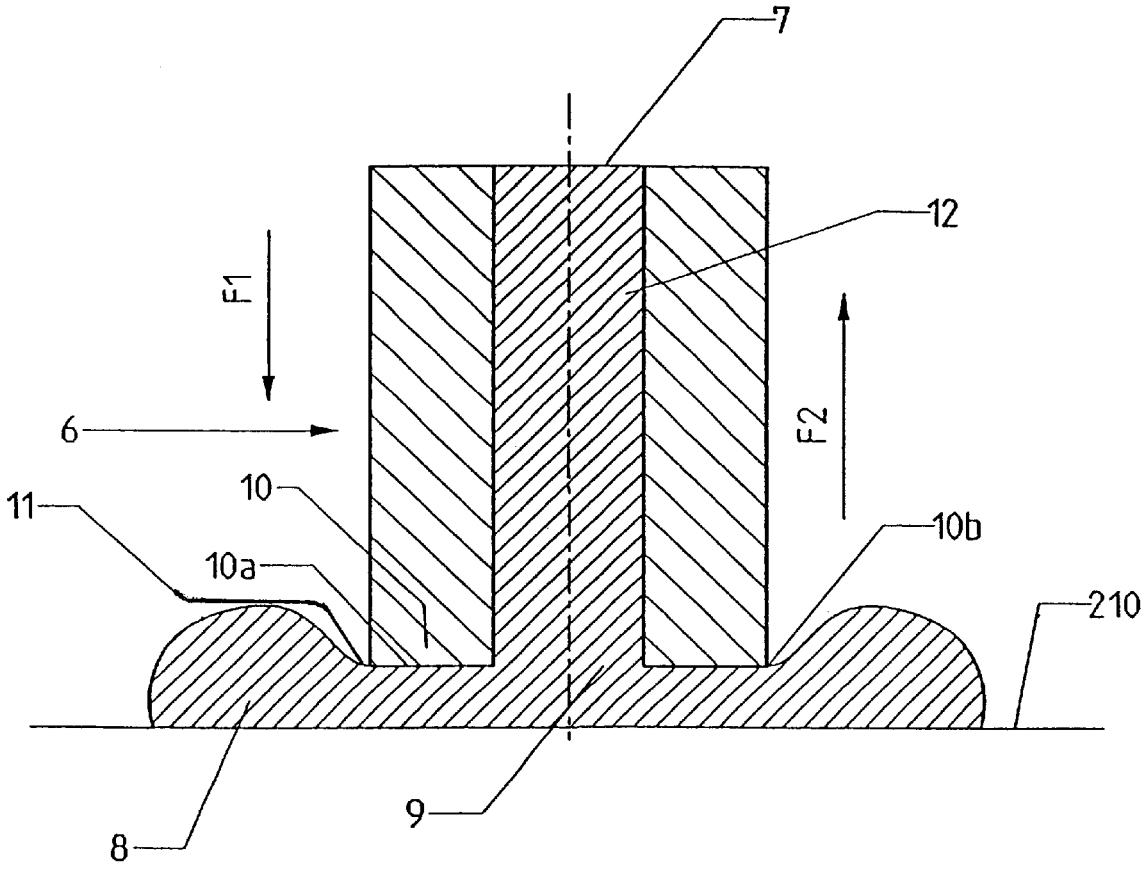
FIG. 4 is a diagram showing a section through a dispensing nozzle illustrating the method of the invention, for applying adhesive to a substrate.

FIG. 4 is a drawing showing a section through a cylindrical dispensing nozzle 6 illustrating in a diagrammatic and non-limiting manner the interaction between the nozzle and dispensed fluid on the substrate, according to the invention. The nozzle 6 has an inner conduit 12 with an entry port 7 and an exit port 9 which is defined by an end portion 10 of the nozzle. The end portion 10 has an annular end surface 10*a* which is a flat surface arranged parallel to the substrate 210 and having an edge 10*b* which defines the perimeter of the end portion. The nozzle 6 is connected to a supply of liquid or paste product 8, which is typically anaerobic adhesive. An applied force F1 acts on the nozzle in a direction towards the substrate 210. The laying on of the fluid 8 onto the substrate 210 effects a thrust upwards against the end portion 10 of the nozzle and the fluid still contained within the inner conduit 12, equivalent to a force F2 acting upwards. This force F2 is related to the pressure integral of the dispensed fluid acting against the area within the perimeter of the end portion 10 of the nozzle. The pressure exerted by the dispensed fluid on the end portion of the nozzle is not constant across the end portion. Due to the interaction between the dispensed fluid and the fluid at the exit port 9, the pressure profile across the end portion is such that the pressure is large at the exit port 9 and reduces in magnitude to atmospheric pressure at the edge portion 10*b* of the end portion 10. As fluid is dispensed, the fluid exerts a pressure upwards causing the nozzle to move away from the substrate, while appearing to float on the dispensed product. The pressure is exerted both on the end portion of the nozzle and on the fluid present in the exit port. This buoyancy of the nozzle 6 is resultant from an essentially hydrostatic thrust bearing on the nozzle, with the buoyant upward force F2 counteracting the downward force F1. It will be understood that FIG. 4 shows a static condition wherein there is no movement of the nozzle along the substrate, and excess dispensed fluid bulges up and about the end portion of the nozzle.

As described previously, anaerobic adhesives cure in the absence of air. Their cure mechanism is, however, sensitive to metals and therefore the nozzle is preferably manufactured from a plastics material such as polyacetal, PTFE or other suitable materials which are chemically neutral with respect to the fluid material and will not initiate curing of the product. It is also possible to use stainless steel or other suitable materials by passivating them. When applied to a metal flange, the metal in the flange acts as an initiator to initiate the curing of the adhesive. On a non-metallic substrate, a primer may be used. By bringing two substrates together it is possible to exclude air from the adhesive and cause the curing process.

In order to facilitate the placement of the adhesive fluid product 8 on a flange or other suitable substrate 210, it is necessary that the dispensing nozzle move about the substrate in a predetermined fashion. The movement of the dispensing nozzle may be achieved by attaching the nozzle to a robot (FIG. 3) and or some other suitable means.

Figure 5:
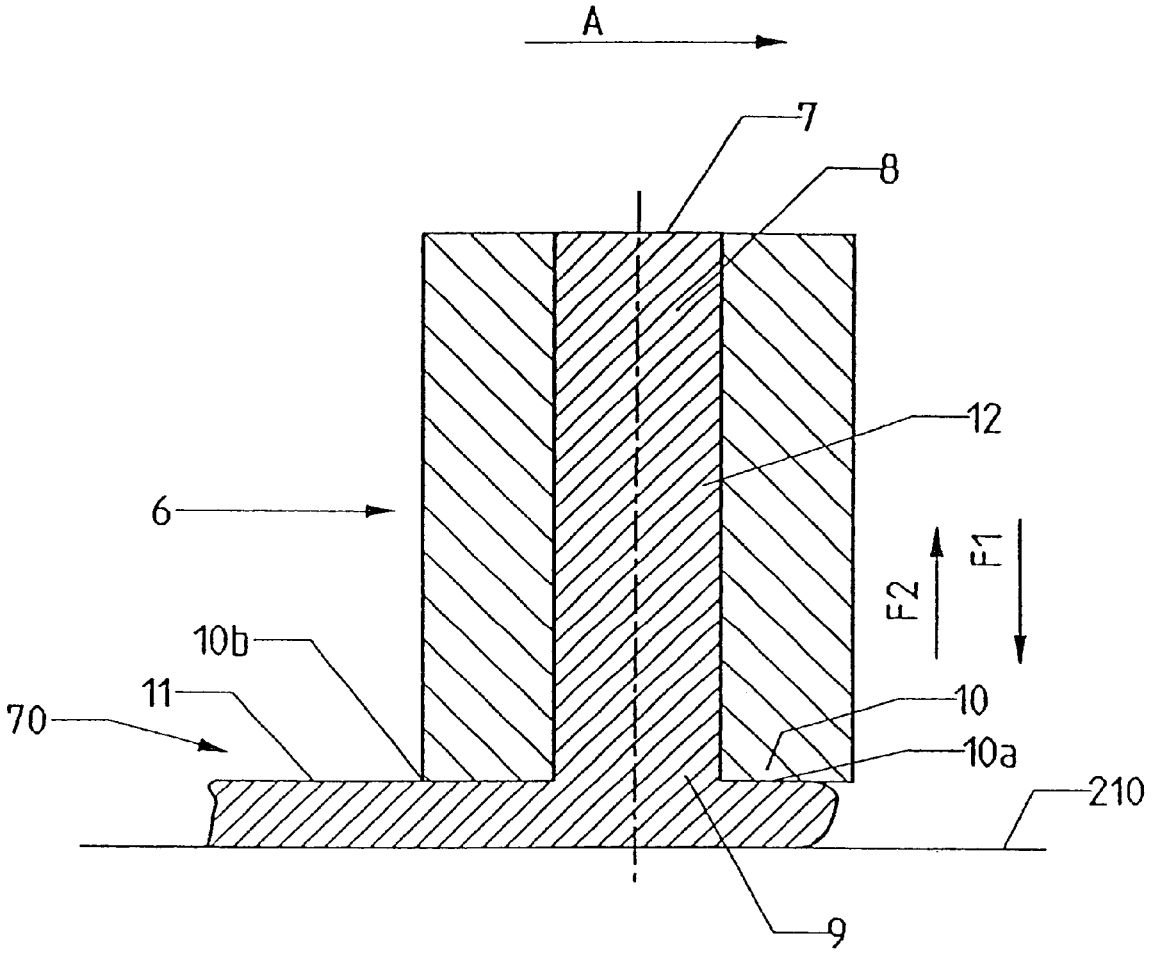
FIG. 5 is a similar diagram showing the effect of the movement of the nozzle of FIG. 4 on the dispensed adhesive product.

FIG. 5 is a drawing showing the effect of the movement (in the direction of arrow A parallel to the substrate) of the nozzle 6 of FIG. 4, on the dispensed ribbon of adhesive product 8. As the nozzle 6 moves it trails a bead of adhesive behind the nozzle. The top surface 11 of the bead is flattened or smeared, the smearing being achieved by the smoothing effect of the end portion 10 and edge portion 10*b* of the nozzle 6 on the dispensed adhesive. As the nozzle moves, as controlled by the robot (FIG. 3), adhesive is laid from the exit port onto the substrate 210, and trails behind the nozzle, being smeared in the process to form a ribbon 70.

If there are any bubbles in the dispensed fluid product these will tend to burst and vent towards the perimeter of the nozzle. The presence of such an air bubble at the exit port will cause a momentary drop in thrust exerted by the dispensed fluid 8 on the end portion 10 of the nozzle, resulting in the upwardly acting force F2 being less than F1. As the device always tries to maintain F2 at the same magnitude as F1, the nozzle will tend to move in a direction towards the substrate 210, thereby reducing the gap between the end portion of the nozzle and the substrate. The height of the nozzle from the substrate affects the height or thickness of the dispensed ribbon relative to the substrate, so that the movement of the nozzle towards the substrate results in a thinner smear of adhesive on the substrate than would otherwise occur, but will not normally cause a break in the ribbon. The passage of the air bubble away from the exit port, such that normal product is being dispensed, re-establishes the upwardly acting force F2, causing the nozzle to move in a direction away from the substrate until F2 is in equilibrium with F1 so that normal application of the adhesive resumes. The passage of the bubble away from the dispensing tip, such that normal adhesive is being dispensed, re-establishes the thickness of the dispensed ribbon.

Figure 7:
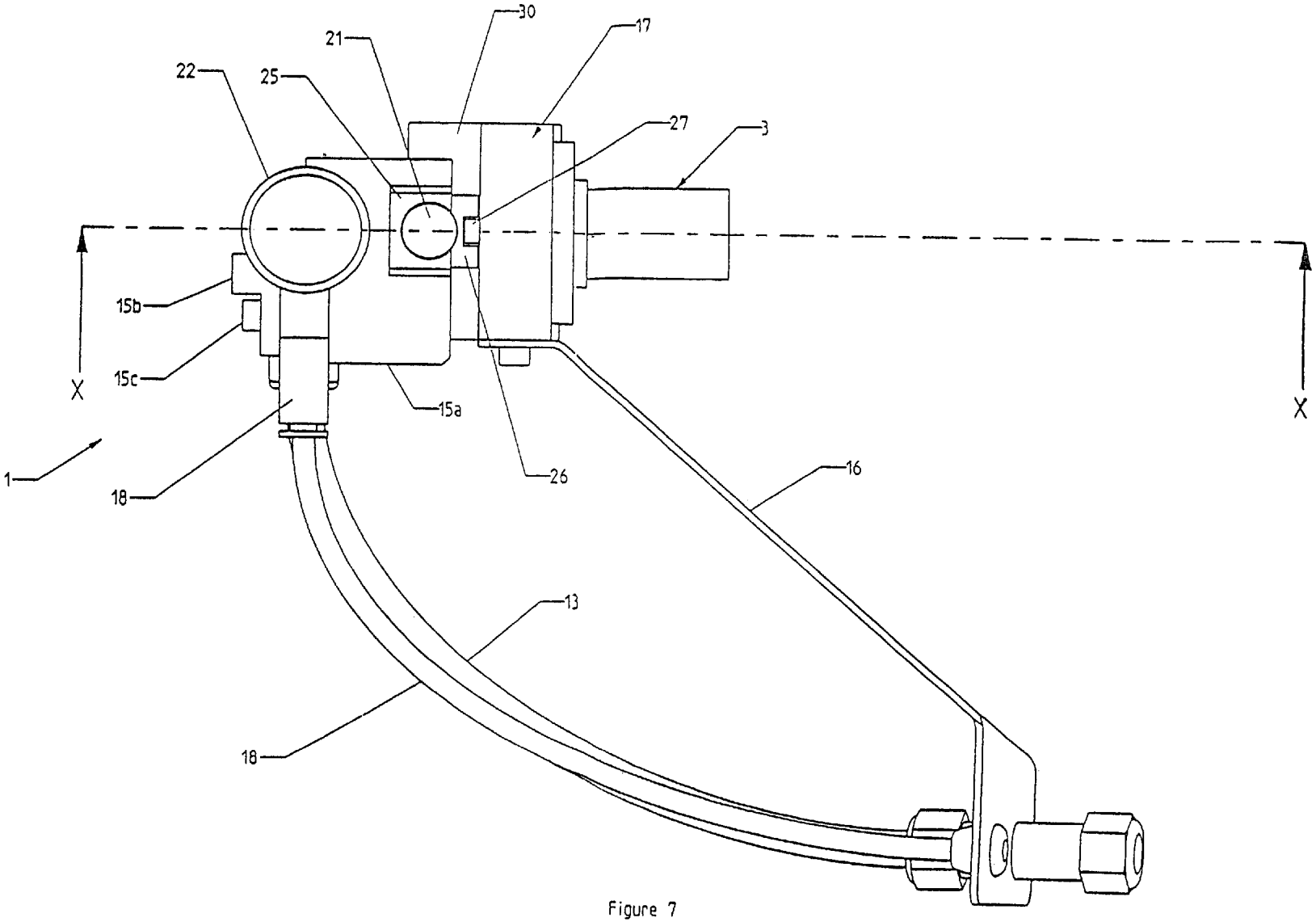
FIG. 7 is a plan view of the device of FIG. 6.
Figure 8:
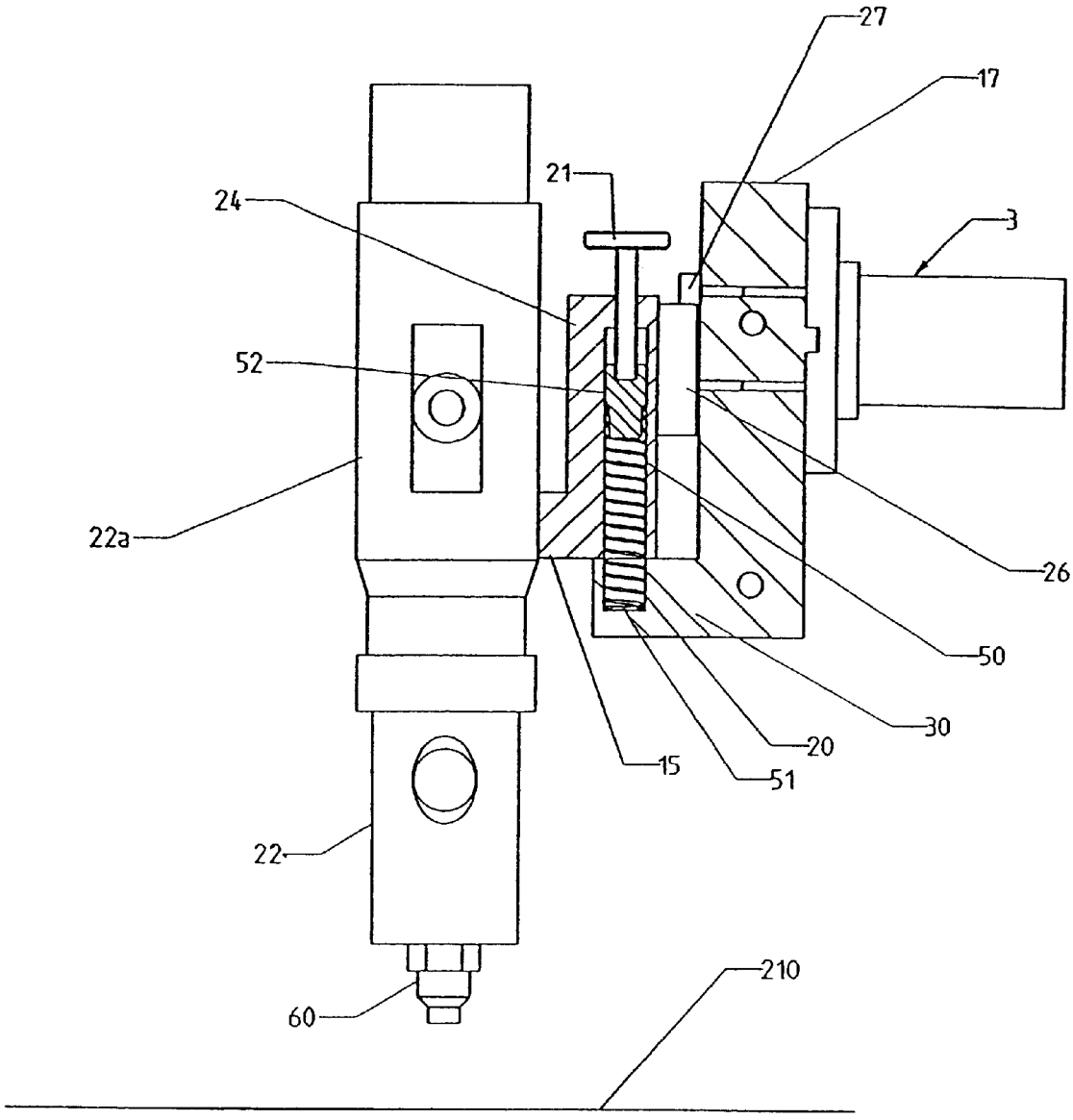
FIG. 8 is a part sectional side elevation of part of the device of FIG. 7, the section being on the line X—X, additionally showing a substrate and the positioning of the device before the dispensing procedure is initiated
Figure 9:
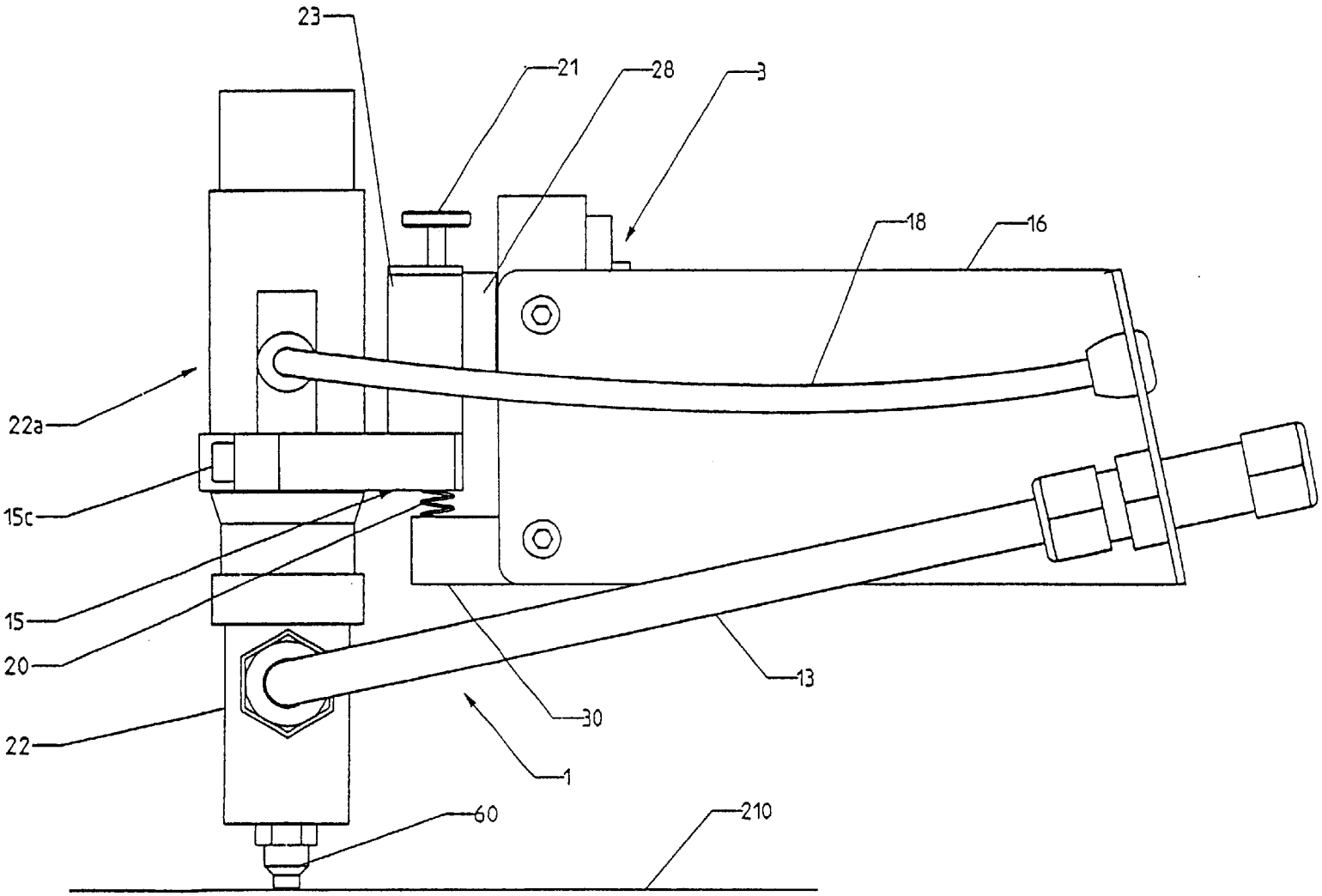
FIG. 9 is a side elevation showing the positioning of the device of FIG. 8 relative to the substrate during dispensing of adhesive on to the substrate.
Figure 10:
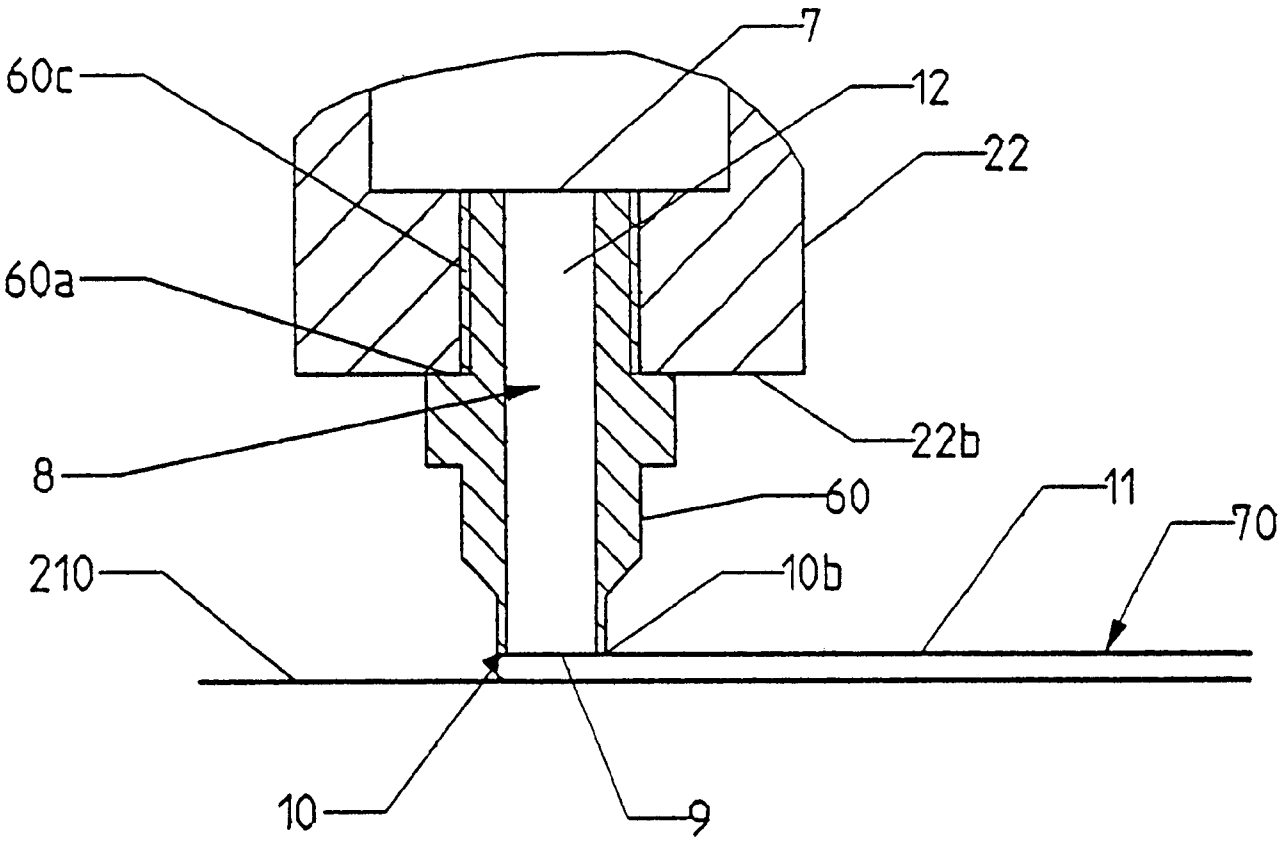
FIG. 10 is a magnified section of the nozzle portion of the device of FIG. 8 during dispensing

FIGS. 6–10 show an embodiment of the device 1 of the invention incorporating a dispensing nozzle 60 mounted for vertical free movement relative to a robot arm 3, and a horizontal substrate 210. Various components of the device 1 that were shown in the functional block diagram of FIG. 3 are shown in practical embodiments in this drawing. The robot (FIG. 3) is programmable and is adapted to move the robot arm around the contours of the substrate 210 (FIGS. 9 and 10). When the robot arm moves, the dispensing nozzle 60 moves with the motion of the robot arm and the product gets smeared behind the nozzle, as was described with reference to FIG. 5. It will be understood that as the nozzle is connected to the robot arm, the movement of the robot arm parallel to the substrate also effects a movement of the nozzle in the same direction or plane as that of the robot arm. The nozzle is, however, also free to move in a direction substantially perpendicular to plane of movement of the robot arm, such free movement being effected by the interaction between the nozzle, the dispensed fluid product and the substrate.

The nozzle 60 is connected to a pneumatically operable valve 22, which has a pneumatic actuator element 22*a*. As seen in FIG. 10, the nozzle has an inner conduit 12 leading to exit port 9 which is defined by a thin-walled cylindrical end portion 10. The nozzle is screwed using screw thread 60 c into a corresponding portion of the valve 22 until an upper ledge portion 60*a* of the nozzle butts against the lower face 22*b* of the valve. The entry port 7 of the nozzle is thus connected to the valve. The valve is secured using a mounting retainer 15*b* (FIG. 6) which is attached to a mounting bracket 15*a* using retainer screws 15*c*. The mounting bracket/retainer combination form a base 15 which when mated with a spring housing 23 form angled valve bracket 24, which is typically L-shaped.

The rear portion of the spring housing 23 is mated with a channel-shaped receiver 26 which when slideably mounted on a monorail 27 forms a slideway 28 perpendicular to the substrate 210. The monorail 27 is secured to an angled mounting flange 17 comprising a leg 29 and base portion 30. The mounting flange 17 is secured at a mechanical interface to a robot arm 3. A spring 20 is positioned and housed within a bore section 50 that extends through the valve bracket 24 and into the base portion 30 of the angled mounting flange 17. The base 51 of the spring 20 is compressed against the base portion 30 by the action of the adjustment screw 21, through a spring support 52. The compression on the spring can be pre-adjusted to a substantially constant predetermined force by altering the position of adjustment screw 21. The advantage of using a spring is that one can precisely adjust the downward force to a load which is accurately known. In this embodiment, the net applied force F1 acting on the nozzle towards the substrate is comprised of the gravitational weight of the overall components, i.e. the nozzle, the valve and the valve bracket, modulated by the force effected by the spring 20 acting in an upward direction, away from the substrate. This latter force acts away from the substrate thereby modulating the gravitation force effected by the weight of the components. As the spring is confined within a bore section 50, the length of which can be adjusted by means of the spring support 52 and the adjustment screw 21, it is possible to predefine the compression state that the spring 20 is initially in, thereby predefining the force effected by the spring in an upward direction, modulating the downwardly acting gravitational force.

It will be understood by those skilled in the art that the spring 20 described above forms a spring component, which has been illustrated for means of convenience as comprising a spring. It is not intended to limit the spring component to a physical spring as it will be appreciated that many spring equivalents are known in the art and are also applicable to this situation.

As the receiver 26 is slideably mounted on the monorail 27 the valve bracket 24 can move relative to the mounting flange 17 in a direction perpendicular to the substrate 210. The extent of movement is constrained at the lower end by the abutment of the base portion 30 and mounting bracket 15*a*. The slideway 28 is incorporated so as to ensure smooth action in one axis only, i.e. a kinematic control. The slideway shown in FIGS. 6 to 9 is a slide table, which is an off-the-shelf standard component such as for example model number VRT1025A available from THK Co. Ltd of Japan. It will be appreciated that any component or set of components which act in the same manner could also be utilised. The downward force F1 necessary to maintain the nozzle in a downwardly acting motion is provided in this embodiment by the weight of the components, mainly the valve 22 and its mounting bracket 24. As this embodiment is being described with reference to the application of a ribbon of adhesive onto a horizontal planar substrate 210, it will be appreciated that the applied force in this embodiment is effectively a gravitational force which is modulated by the counter-acting controlled spring 20, which is in compression.

Additionally, a support bracket or retainer 16 is also attached to the flange 17. Two supply tubes, a product feed tube 13 and pneumatic control tube 18 are secured by the support retainer 16 before being connected to valve 22 and to a pneumatic motor control component 22*a* of the valve 22, respectively. The securing of the supply tubes to the support retainer 16 minimises any drag effect on the valve 22 by the supply tubes when the nozzle moves relative to the flange 17.

As described above the means for mounting the nozzle may suitably comprise slide means such as a slideway or other guide means in which only one component is allowed to move to and fro in one axis or direction relative to another component. One component suitably comprises the moveable nozzle and the other component is secured to the robot arm.

By incorporating the valve 22 near the point of application it is possible to better control the flow, particularly at both of the start and the end of the dispensing procedure, than having the valve at the product supply container. The desirability of the valve is due to the elastic nature of the product supply line elements and of the dispensed product which can result in a time lag between the stopping or initiating of dispensing.

The slideway 28 and support bracket 16 form the kinematic control functional block 4 referred to in FIG. 3. The support bracket 16 additionally is part of the force control functional block 5 in that it serves to control the force exerted by the supply lines on the valve 22 and thus on the nozzle.

It is common in many applications that the product to be dispensed is remotely located from the dispensing nozzle. As such it is necessary to transfer the product from its reservoir to the dispensing nozzle. Such transport is normally achieved using product supply lines. In this embodiment, it is also necessary to incorporate pneumatic tube(s) 18 for controlling the operation of the dispensing valve 22. The effect of such product and control lines can induce a variation on the loading on the nozzle due to the motion of the robot, which variation can cause fluctuations in the amount dispensed. It is important to maintain a constant vertical loading to ensure a consistent ribbon of gasket product.

The purpose of using a support bracket 16 for the product 13 and the pneumatic tubes 18 is to maintain the vertical component forces substantially constant. The loading associated with the product and pneumatic tubes can cause variations in the loading of the nozzle, and as such reduce the quality of the applied liquid gasket. Support bracket 16 isolates the floating nozzle from the variable loading of the tubes as the robot moves. The bracket 16 is secured to the mounting flange 17, and moves with the robot arm 3 but does not move with the valve 22.

The force acting towards the substrate can be provided in one of many ways: it is possible to springload the nozzle either with a mechanical spring or pneumatic actuator or it is possible to use selected weights which will supplement the gravitational force towards the substrate. By altering the downward force applied towards the substrate it is possible to alter the thickness of adhesive product that is applied to the substrate. It will be appreciated that the abutment of the base portion 15*a* against the base 30 of the mounting flange 17 as shown in FIG. 8 represents the lowest positioning of the nozzle relative to the mounting flange. In the drawing of FIG. 9 as the device is brought closer to the substrate 210 using the movement of the robot arm, so as to initiate dispensing, the interaction between the nozzle, dispensed product on the substrate and substrate (force F2) will effect a movement of the valve bracket base portion 15*a* away from the base 30 of the mounting flange 17, in a similar manner to that described with reference to FIGS. 4 and 5. The receiver 26 of the slideway is higher on the monorail 27 than is shown in FIG. 8, so that the nozzle is free to move up and down relative to the substrate 210.

For applications where gravitational forces are insufficient or unsuitable for effecting a force towards the substrate it will be appreciated that an alternative loading arrangement will be required.

Figure 11:
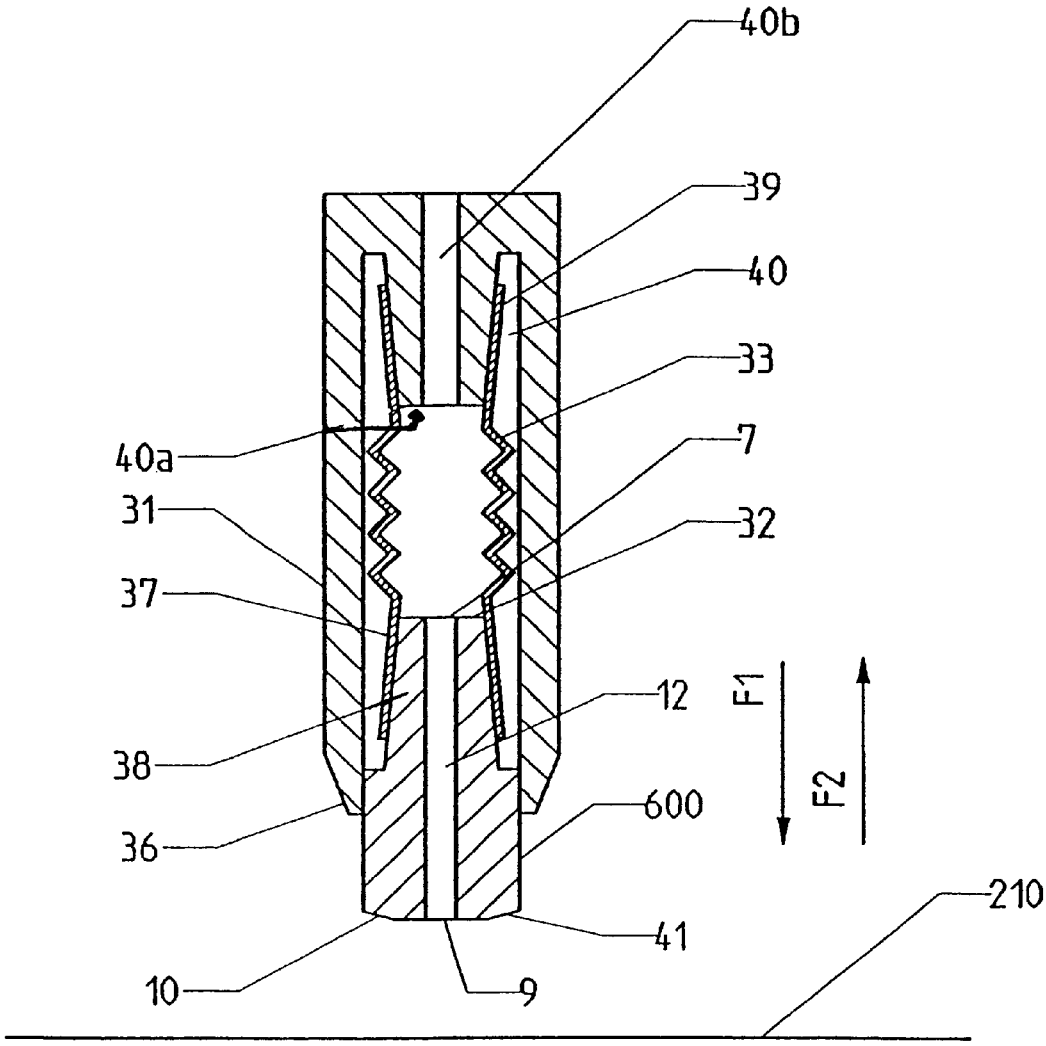
FIG. 11 is a section through a nozzle in accordance with a second embodiment of the invention.

In an alternative embodiment, shown in section in FIG. 11, only the nozzle 600 floats or moves with respect to the substrate 210. The nozzle has an exit port 9 defined by an end portion 10, the exit port 9 separated from the entry port 7 by an inner conduit 12. The nozzle is mounted within a bellows arrangement 33, which allows movement of the nozzle within the constraints of a generally cylindrical guide 36. The lower portion 37 of the bellows is attached to a tapered upper portion 38 of the nozzle and the upper portion 39 of the bellows is constrained within a receiving portion 40 formed within the guide 36. The guide 36 has an end portion 40*a* which is penetrated by a supply bore 40*b* aligned with the conduit 12 of the nozzle. The space defined by the bellows 33, the upper face 32 of the nozzle 600 and the end portion 40*a* of the guide 36 forms a dispensing well 31 to which the dispensable material is supplied under pressure. In use the nozzle 60 is free to move within the constraints of the nozzle guide 36 and bellow 33, which act as components of the kinematic control described in FIG. 3. An applied force F1 is generated by the pressure exerted by the product, while in the dispensing well 31, on the upper face 32 of the nozzle. By constraining the nozzle within the bellows type arrangement 33, and mounting the guide 36 with its axis perpendicular to the axis, the nozzle 600 is free to move towards and away from the substrate 210 depending on the magnitude of the upwardly acting force F2, which will fluctuate as described previously. In this arrangement the movement of the nozzle 600 is independent of the other components of the apparatus and therefore the product and pneumatic tubes (see FIG. 6) do not affect the floating portion of the system, and no bracket 16 is required to restrain the tubes. Nevertheless, it is practical to incorporate a valve 22 which controls the flow of fluid at the start and completion of the dispensing procedure.

Although the chamfered portion 41 of the end portion 10 will affect the characteristics of the pressure profile across the end portion the methodology of the effect is the same as previously described.

Figure 12:
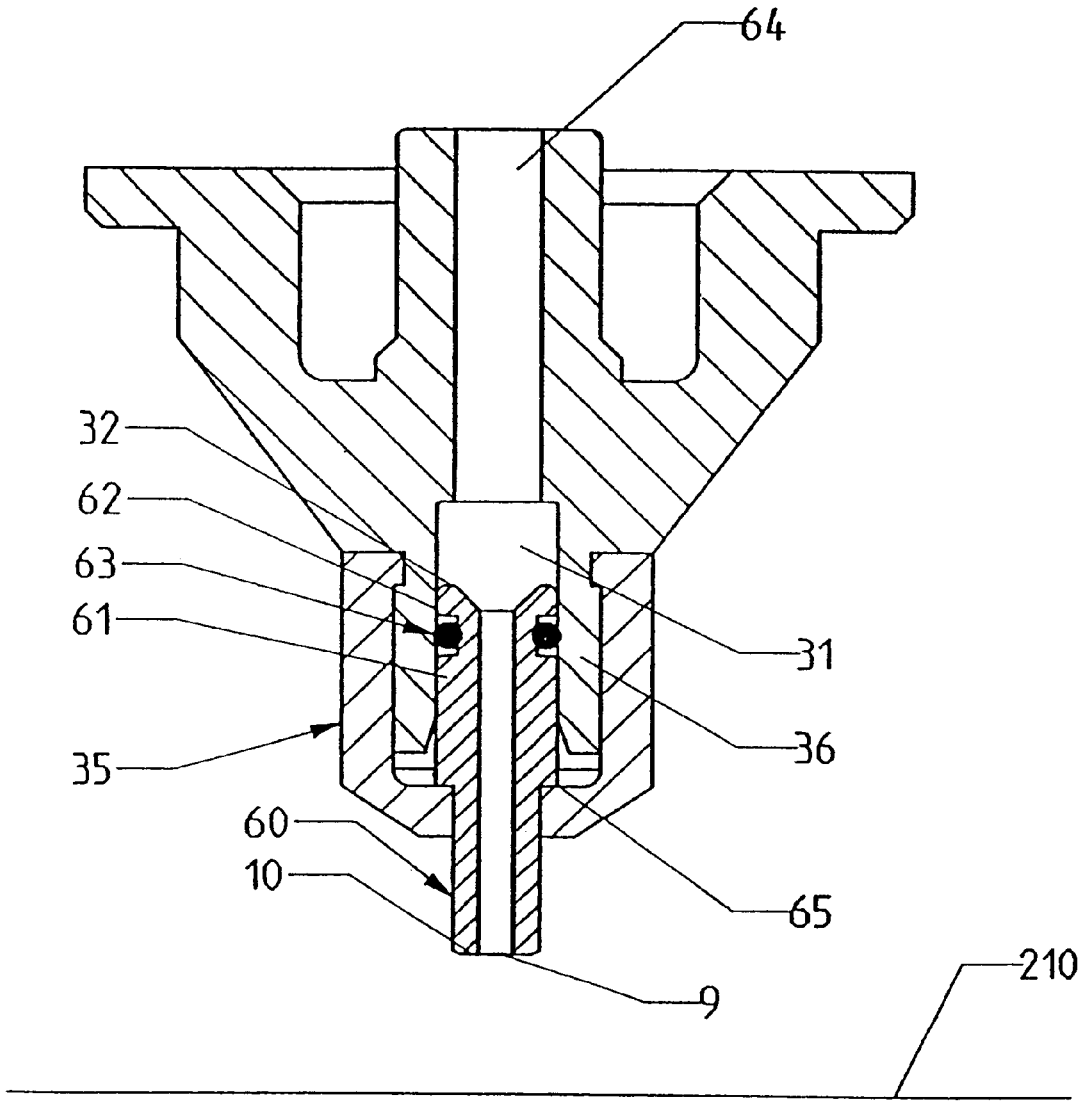
FIG. 12 is a section through a nozzle in accordance with a third embodiment of the invention.

FIG. 12 illustrates a nozzle in a further embodiment of the present invention. Similarly to that described with reference to FIG. 11, in this embodiment the nozzle 600 is free to move independent of the remaining apparatus. The nozzle is mounted within the constraints of a guide 36, which defines the degree of movement allowable to the nozzle 60. In the upper portion 61 of the nozzle 60 a circumferential channel 62 is formed which serves as a receiver for an O-ring 63 which is slideable relative to an inner wall of the guide 36. A dispensing well 31 is defined between the upper face 32 of the nozzle and a channel 64 which supplies dispensable material from the product reservoir. The O-ring 63 acts as a seal between the dispensing well 31 and the outer portion of the nozzle 60, thereby preventing the passage of product between the nozzle 60 and the guide 36. A stop member 35 is mounted on the outer portion of the guide 36. The abutment of a ledge 65 on the nozzle 60 against the stop member 35 prevents the nozzle falling from the bottom of the guide 36. This abutment, as illustrated in FIG. 12, shows the lowest possible position of the nozzle and in a similar manner to that described with reference to FIG. 8 would represent in use, the resting of the nozzle on the substrate. Similarly to that described with reference to FIG. 11 the applied force is generated by the force exerted by the fluid on the upper face 32 of the nozzle 60 while present in the dispensing well 31. The additional stop member 35 is incorporated to restrict the nozzle 60 in its degree of freedom.

The embodiments of FIGS. 11 and 12 can also be used to apply adhesive to non-horizontal substrates. e.g., vertical substrates, the nozzle being mounted for free movement substantially perpendicular to the substrate.

Figure 13:
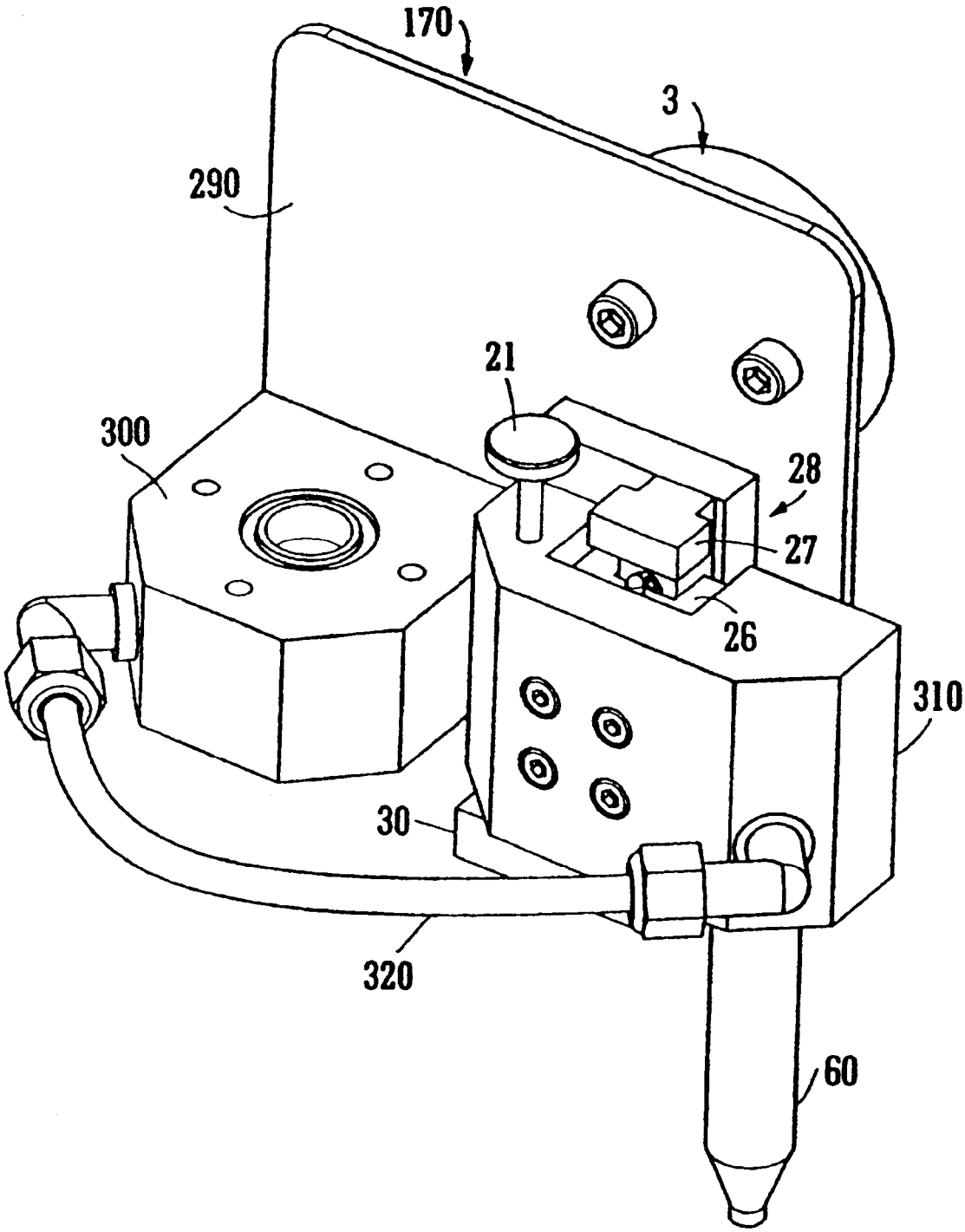
FIG. 13 is a perspective view from above of an alternative mounting method for the nozzle of the present invention.
Figure 14:
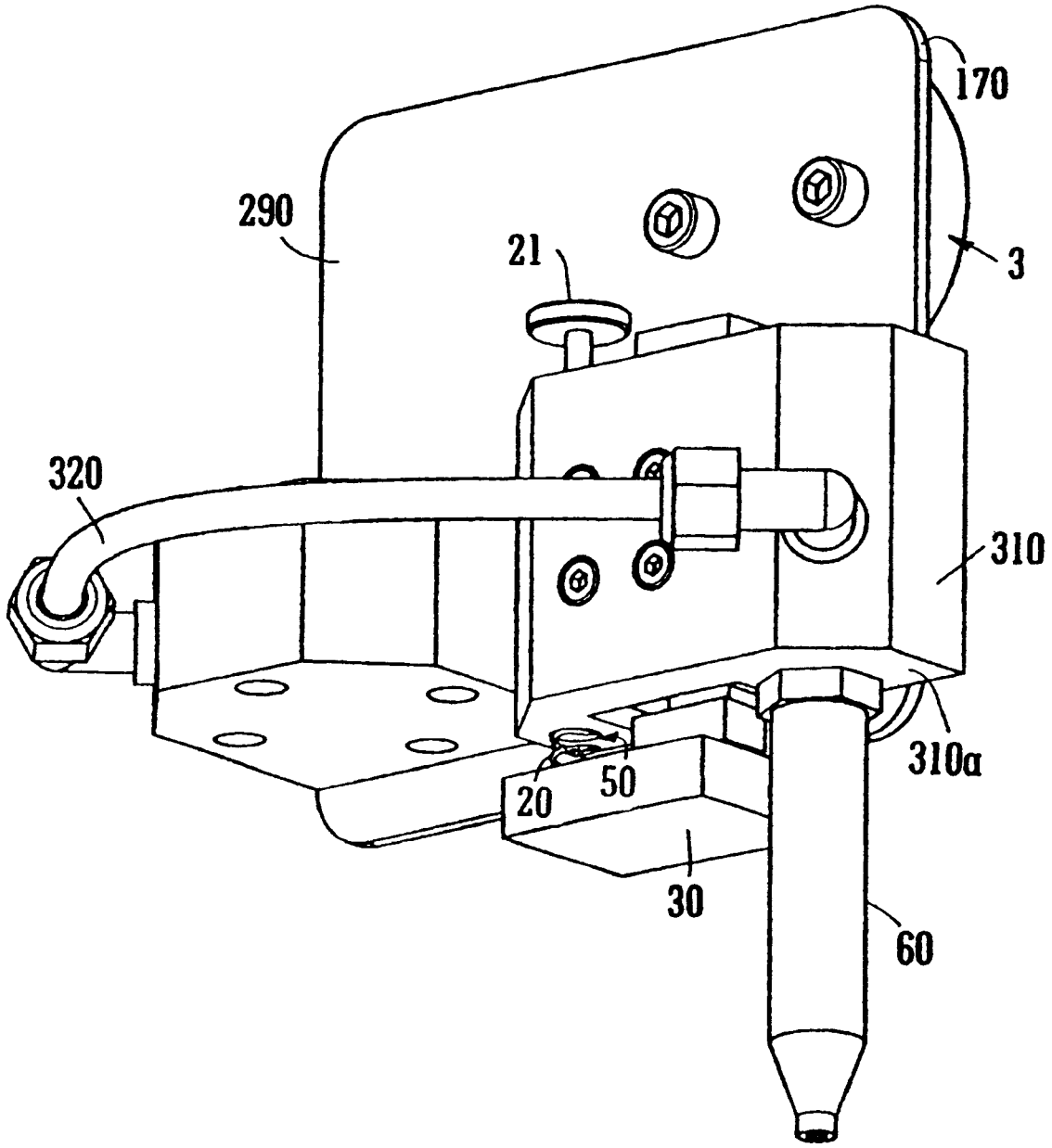
FIG. 14 is a perspective view from below of the embodiment of FIG. 13.

FIGS. 13 and 14 are perspective views of an alternative mounting method for the nozzle of the present invention. Differing from that disclosed with reference to FIGS. 6 to 10, in this embodiment the valve is not positioned directly above the dispensing nozzle. The same reference numerals are used for similar components, which are operable in a similar manner to that previously described. A support flange 170, similar to that of the flange 17 is provided, on which is mounted a slideway 28 comprising a receiver 26 slideably mounted on a monorail 27. The receiver 26 is mateable to a nozzle support housing 310 which allows a free vertical movement of the nozzle support housing 310 relative to the support flange 170 in a direction substantially perpendicular to a horizontal substrate. In a similar manner to that described previously, the compression on the spring 20, which is housed within a bore section 50 of the support housing 310, is adjustable using an adjustment screw 21. The extent of motion of the nozzle support housing 310 is limited in the downward direction by an abutment of the lower face 310*a* of the support flange against the base portion 30.

Figure 6:
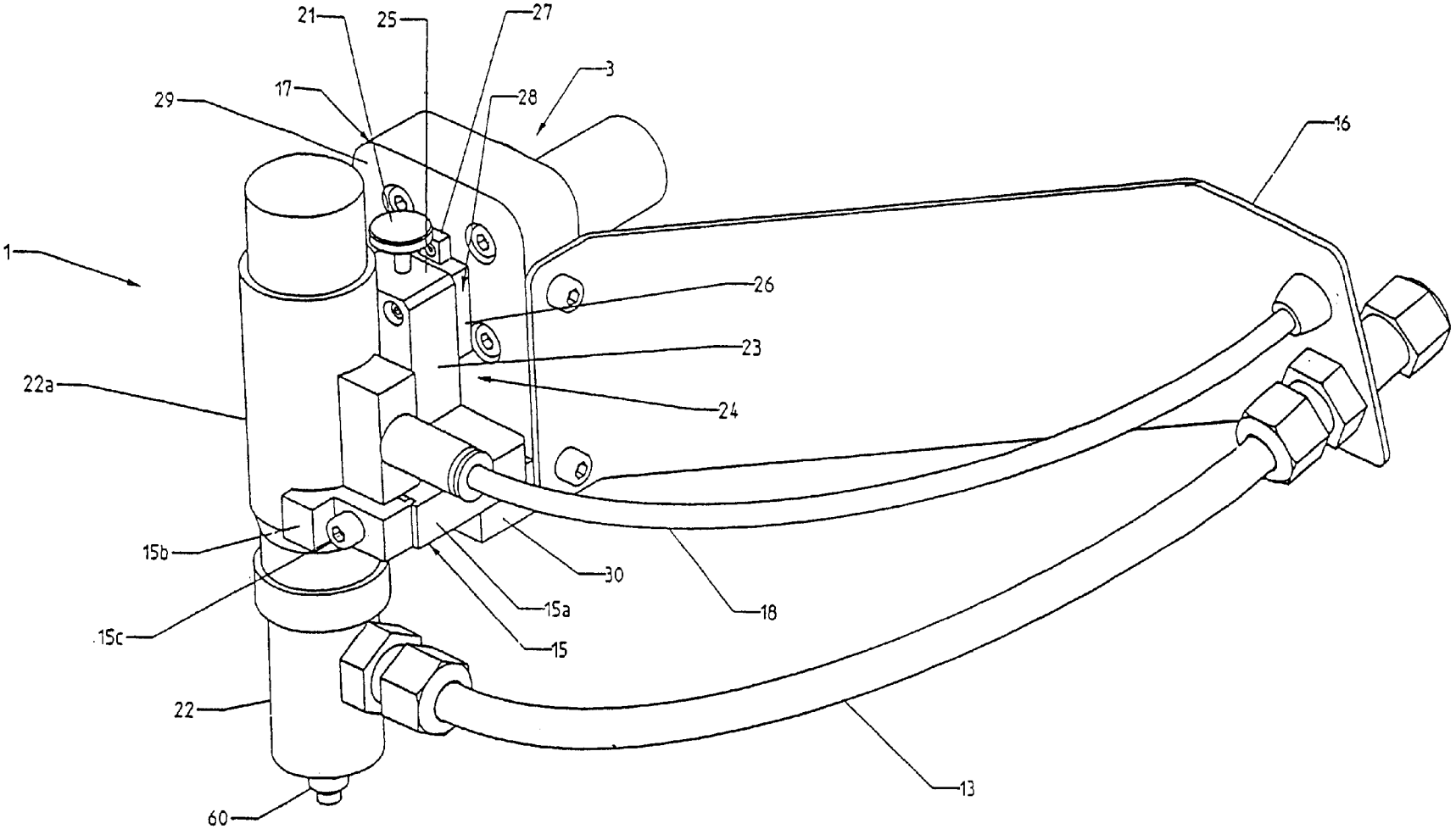
FIG. 6 is a perspective view of a device according to the invention showing a dispensing nozzle and the means for mounting the nozzle to a robot arm.

The embodiment illustrated in FIGS. 13 and 14 differs from that previously disclosed in the position of the valve relative to the dispensing nozzle. In this embodiment the valve is not seated or situated directly above the nozzle, and the weight of the valve is therefore not acting on the slideway 28. The support flange 170 additionally comprises a valve support 300 which is separate from the nozzle support housing 310. The valve support 300 is adapted to support and mate with a valve 22 and its associated pneumatic motor control components, pneumatic control lines and product feed lines (as shown in FIGS. 6 and 7). By providing the valve with an independent support means directly connectable to the support flange 170, there is no movement, during use of the apparatus, of the valve relative to the support flange 170. The downward force F1 necessary to maintain the nozzle in a downwardly acting motion is provided in this embodiment by the weight of the moveable components, mainly the nozzle support housing 310. The movement of the nozzle 60 relative to the substrate is independent of the valve and there is therefore no requirement to utilise means such as the support retainer 16 to minimise any drag effect introduced by movement of the product and pneumatic feed lines. A second product feed line 320 is provided between the valve support 300 and the nozzle support 310 so as to effect the controlled provision of product to the inner conduit of the nozzle for dispensing.

Figure 15:
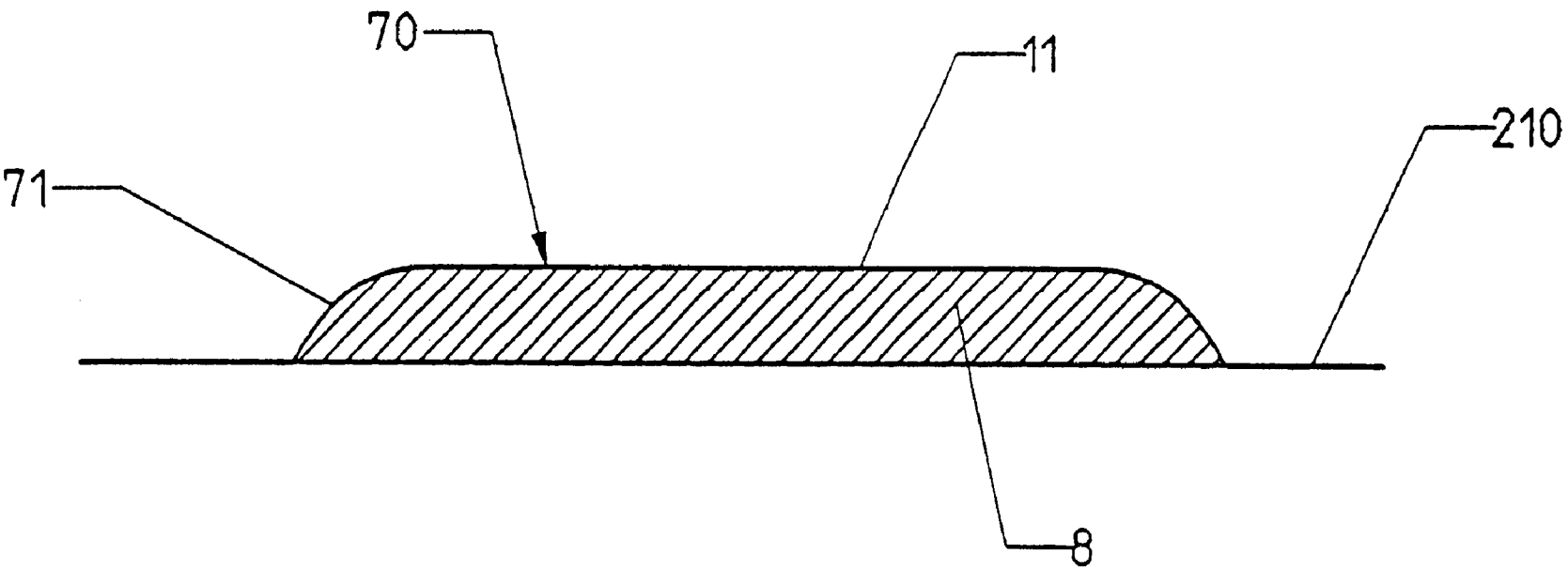
FIG. 15 is a transverse section through a dispensed bead of adhesive as dispensed according to the method of the present invention.

By utilising a nozzle as hereinbefore described it is possible to apply high quality ribbon of applied adhesive in quantities an order of magnitude smaller than previously achievable. The quality of the ribbon refers to the lack of breakage in the applied ribbon. FIG. 15 is a transverse section across a ribbon 70 of adhesive 8 on a substrate 210 as applied using a device of the present invention. The ribbon is smeared on dispensing by a nozzle (FIGS. 4 to 14) so as to form a substantially flat surface 11. The curved edge portions 71 result from some seepage of the dispensed adhesive beyond the surface defined by the nozzle end portion, and surface tension effects.

As used herein the term "degree of movement" or "degree of freedom" is meant a mode of motion with respect to a co-ordinate system, independent of any other mode. The term will be well understood by those in the art who will appreciate that the nozzle of the present invention when attached to a robot arm is moveable with the robot arm in the "x" and "y" direction about the substrate, thereby applying dispensing product to different regions of the substrate. At the same time the invention provides a nozzle capable of also moving in the "z" direction, the movement in the "z"

direction being a movement substantially perpendicular to the substrate, which will be understood also effects a movement of the nozzle relative to the robot arm. This movement, or degree of movement, in the "z" direction is effected by the interaction between the nozzle end portion, the dispensed product and the substrate.

The quality of the beading is related to the size of the outside diameter of the nozzle and the absence of breaking of the ribbon occurring during dispensing. In one example using a nozzle the outside diameter of the end portion of which was 4 mm, and the exit port defined by said end portion 3 mm, it was possible to apply a ribbon of width 5 mm. This ribbon had a thickness of approximately 200 $\mu$, which equates to an applied product of approximately 1 $g/m^2$. When equated to the dispensed bead discussed with reference to the prior art methods it will be realised that the method of the present invention facilitates the application of adhesive of higher quality on the substrate, yet does not require the same volume to be dispensed.

Example of Product Viscosity

The viscosity of product to be used with the device and method of the present invention include the following:

| Product | DIN viscosity (mP · s) |
|---|---|
| Anaerobic Adhesive 1 | 7,500 |
| Anaerobic Adhesive 2 | 55,000 |
| Anaerobic Adhesive 3 | 55,000 |
| Anaerobic Adhesive 4 | 20,000 |
| Anaerobic Adhesive 5 | 90,000 |

Example of Dispensing Procedure

1. As there is no dispensable material initially present in the exit port of the nozzle, if the nozzle was positioned on the substrate surface no buoyant force would be present and the nozzle would rest on the surface. To obviate this resting on the nozzle, the apparatus is positioned initially using the robotic arm such that the nozzle is at a height approximately 50 mm above the start point on the flange on which the adhesive is to be dispensed.
2. The valve is opened to allow the product to flow.
3. The apparatus is moved using the robot towards the substrate, with the open valve ensuring that there is product at the nozzle end portion by the time the nozzle assumes the position at the start of the tracing run. The nozzle does not come into contact with the substrate but rather is presented to dispensed material on the substrate.
4. A ribbon is traced on the flange by movement of the nozzle on its robot arm in a predetermined manner.
5. Once the trace is completed, the valve is closed.
6. The apparatus and attached nozzle are moved away from the substrate.

The first three steps are to ensure that there is product present at the exit port at the start of the tracing procedure. A "squeeze film", the term defining the situation when two flat surfaces approach with a liquid in between, results from the presence of the product between the nozzle and the substrate. This squeeze film minimises the possibility of the nozzle coming into contact with the substrate, reducing the possibility that the nozzle is contaminated by any material present on the substrate.

Suitably the product reservoir is pressurised in the range from 2 bar to 40 bar, more particularly 2 bar to 10 bar, and/or an auxiliary pump is provided in the supply line between the reservoir and the valve to increase the pressure of the product into the ranges mentioned above. The pressure will vary depending upon various factors, including the viscosity of the product and the nature of the equipment on the supply route between the reservoir and the nozzle. There is a loss of pressure along the supply line, so that the pressure at the exit port of the nozzle is likely to be less than 1 bar.

The invention has been described with particular reference to anaerobic adhesives/sealants. However the invention is also applicable to other fluid dispensable materials, particularly such materials which carry a significant content of air or other gases.

Words such as "top", "above", "upper", "lower", "upwards", "downwards", "height", "up and down", "floats" and the like are used herein with reference to the positions of the device and/or the components thereof illustrated in the drawings and do not necessarily relate to the positions adopted when the device is in use. Such terms are used without limiting effect. The words "comprises/comprising" and the words "having/including" when used herein with reference to the present invention are used to specify the presence of stated features, integers, steps or components but do not preclude the presence or addition of one or more other features, integers, steps, components or groups thereof.

While described in detail here, many modifications and equivalents thereof will be clear to those persons of ordinary skill in the art and are intended to be covered hereby, the full measure of the spirit and scope of the invention being defined by the claims.

I claim:

1. A device for the dispensing of a fluid dispensable material in ribbon form to a substrate comprising:

a) a robot arm programmable to move about the substrate in a plane substantially parallel to the substrate, b) at least one dispensing nozzle having at least one inner conduit leading to exit port and adaptable to be in fluid communication with a supply source for the fluid dispensable material, the nozzle having an end portion defining the exit port such that a ribbon of dispensed fluid material can be applied to the substrate, c) means for mounting the nozzle for substantially perpendicular free movement relative to the substrate such that at least part of the end portion of the nozzle maintains contact with the fluid material applied to the substrate, movement towards the substrate being effected by an applied force and movement away from the substrate being effected by a thrust exerted by the dispensed fluid material against said end portion of the nozzle and the dispensable material in the exit port, d) a slide mounting means for mounting the nozzle relative to the robot arm, the slide mounting means allowing free movement of the nozzle to and relative to the robot arm in a direction substantially perpendicular to the plane of movement of the robot arm, e) a spring component acting on the slide mounting means, and f) adjustment means acting on the spring component so that an applied force on the nozzle is modulated to maintain equilibrium between movement of the nozzle towards the substrate and away from substrate during the dispensing procedure.

2. The device as claimed in claim 1 wherein the means for mounting the nozzle maintain an equilibrium between the movement towards the substrate and movement away from the substrate during the dispensing procedure, with the thrust exerted by the dispensed fluid material being substantially equal in magnitude to the applied force such that the nozzle floats on the dispensed ribbon of material.

3. The device as claimed claim 1 wherein the thrust exerted by the dispensed fluid material against the end portion of the nozzle and the fluid present in the exit port is equivalent to an buoyant force.

4. The device as claimed in claim 3 wherein a perimeter of the nozzle end portion defines a reaction area against which the buoyant force, which is related to a pressure integral of pressure exerted by the dispensed material on the reaction area, may react.

5. The device as claimed in claim 1 wherein the at least one nozzle is a single nozzle having a single inner conduit, the end portion of which is preferably an annular shaped surface.

6. The device as claimed in claim 1 wherein the end portion of the nozzle is mounted so that an end force thereof is substantially parallel to said substrate.

7. The device as claimed in claim 1 wherein the end portion has an outside diameter in the range from about 2.5 mm to about 10 mm and the exit port defined by said end portion has a diameter in the range 1 mm to about 5 mm.

8. The device as claimed in claim 1 for dispensing an adhesive and preferably an anaerobic adhesive.

9. The device as claimed in claim 1 for dispensing a fluid whose DIN viscosity is in the range from about 7,500 to 90,000 mP.s.

10. The device is claimed in claim 1 wherein the nozzle is connected to a valve, an upper ledge portion of the valve butting against a lower face of the valve and the means for mounting the nozzle for substantially perpendicular free movement relative to the substrate allows a movement of the valve and nozzle combination.

11. The device as claimed in claim 1 wherein the nozzle is in fluid communication with a valve, the valve being located remotely from the nozzle and the means for mounting the nozzle for substantially perpendicular free movement relative to the substrate allows no movement of the valve.

12. The device as claimed in claim 1 further comprising a spring component, wherein the applied force comprises a gravitational force component effected by the weight of the means for mounting the nozzle acting in a direction towards the substrate modulated by the force effected by the spring component acting in a direction away from the substrate.

13. An apparatus for dispensing a fluid product onto a substrate, the apparatus comprising a nozzle and means for mounting the nozzle with at least one degree of freedom allowing movement of the nozzle relative to the substrate, with movement towards the substrate being effected by a substantially constant force acting on the nozzle and movement away from the substrate being effected by a force related to the pressure exerted by the dispensed fluid on the nozzle.

14. The apparatus as claimed in claim 13 wherein the substantially constant force which effects movement towards the substrate comprises a gravitational component modulated by a counter-acting spring component, the magnitude of the substantially constant force being chosen so as to be substantially equal in magnitude to the force effecting movement away from the substrate.

15. The apparatus as claimed in claim 13 wherein the nozzle is in fluid communication with a product reservoir which is pressurised such that the product is dispensed under pressure.

16. The apparatus as claimed in claim 13 having means for mounting the nozzle such that the interaction between the nozzle and the dispensed product allows the nozzle to adjust its height relative to the substrate as a result of variations in the dispensed product.

17. The apparatus as claimed in claim 13 wherein the nozzle has an inner conduit leading to an exit port and adapted to be in fluid communication with the product reservoir, the nozzle having an end portion, the diameter of the end portion being 10 to 30% smaller that the width of the fluid product to be dispensed on the substrate.

18. A method for dispensing a fluid dispensable material to a substrate comprising the steps of a) mounting a dispensing nozzle, in a manner which allows substantially perpendicular free movement of the nozzle relative to the substrate, b) facilitating the application of an applied force on the dispensing nozzle to effect movement of the nozzle in a direction towards the substrate, and c) supplying the fluid dispensable material to an exit port which is defined by an end portion of the nozzle, applying the material to the substrate and controlling the applied force in relation to a thrust exerted by the dispensed fluid material on the end portion of the nozzle and the dispensable material therein such that the end portion of the nozzle maintains contact with the dispensed material applied to the substrate.

19. The method as claimed in claim 18 wherein the fluid is laid onto the surface in a ribbon of material.

20. The method as claimed in claim 19 wherein the thrust exerted by the dispensed fluid is substantially equal in magnitude to the applied force such that the nozzle floats on the dispensed fluid.

21. The method as claimed in claim 18 wherein the thrust exerted by the dispensed fluid on the nozzle is a buoyant force which is related to one or more of the following:

a) the pressure exerted by the dispensed fluid on the nozzle end portion, b) the pressure exerted by the dispensed fluid on the fluid material at the exit port, and c) the distance of the nozzle away from the substrate, wherein the nozzle adjusts its position relative to the substrate as a result of fluctuations in the magnitude of said buoyant force.

22. The method as claimed in claim 18 wherein a ribbon of dispensed fluid material is applied onto the substrate at a thickness greater than the surface roughness of the substrate.

23. The method as claimed in claim 18 wherein the pressure exerted by the dispensed fluid on the nozzle is less than the force acting towards the substrate so that the nozzle rides on the substrate resulting in local points of contact between the substrate and the nozzle.

24. A method for dispensing a fluid dispensable material from a nozzle to a substrate comprising the steps of a) supplying the fluid dispensable material to an exit port which is defined by an end portion of the nozzle, b) applying the material to the substrate, c) smearing the applied material with the end portion of the nozzle, the width of the applied smeared material on the substrate being related to the diameter of the end portion of the nozzle.

25. The method as claimed in claim 24 wherein the width of the applied smeared material is about 10% to about 30% larger than the diameter of the end portion of the nozzle.

26. A device for the dispensing of a fluid dispensable material in ribbon form to a substrate comprising:

a) a robot arm programmable to move about the substrate in a plane substantially parallel to the substrate, b) at least one dispensing nozzle having at least one inner conduit leading to an exit port and adaptable to be in fluid communication with a supply source for the fluid dispensable material, the nozzle having an end portion defining an exit port such that a ribbon of dispensed fluid can be applied to the substrate, and c) means for mounting the nozzle for substantially perpendicular free movement relative to the substrate such that at least part of the end portion of the nozzle maintains contact with the fluid material applied to the substrate, movement towards the substrate being effected by an applied force and movement away from the substrate being effected by a thrust exerted by the dispensed fluid material against said end portion of the nozzle and the dispensable material in the exit port.

* * * * *